US012492605B2

(12) United States Patent
Bay et al.

(10) Patent No.: US 12,492,605 B2
(45) Date of Patent: Dec. 9, 2025

(54) TREE ADAPTER AND TUBING HANGER INTERFACE TOOL SYSTEM AND METHOD

(71) Applicant: Baker Hughes Oilfield Operations LLC, Houston, TX (US)

(72) Inventors: Yew Jack Bay, Jandakot (AU); Andrew Watts, Jandakot (AU); Calum Boyle, Jandakot (AU)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/621,847

(22) Filed: Mar. 29, 2024

(65) Prior Publication Data

US 2024/0328275 A1 Oct. 3, 2024

Related U.S. Application Data

(60) Provisional application No. 63/456,570, filed on Apr. 3, 2023.

(51) Int. Cl.

| | |
|---|---|
| ***E21B 3/04*** | (2006.01) |
| ***E21B 3/06*** | (2006.01) |
| ***E21B 33/04*** | (2006.01) |
| ***E21B 33/06*** | (2006.01) |

(52) U.S. Cl.
CPC ..... *E21B 33/04* (2013.01); *E21B 33/06* (2013.01)

(58) Field of Classification Search
CPC ..... E21B 33/04; E21B 33/06
See application file for complete search history.

(56) References Cited

U.S. PATENT DOCUMENTS

| | | | | |
|---|---|---|---|---|
| 5,544,707 | A | 8/1996 | Hopper et al. | |
| 6,488,083 | B2 * | 12/2002 | Bartlett | E21B 33/0355 166/321 |
| 6,675,900 | B2 | 1/2004 | Baskett et al. | |
| 6,763,891 | B2 * | 7/2004 | Humphrey | E21B 33/0353 166/88.1 |

(Continued)

FOREIGN PATENT DOCUMENTS

| | | | | |
|---|---|---|---|---|
| CN | 114856504 | A | 8/2022 | |
| EP | 1350919 | A2 * | 10/2003 | E21B 33/035 |

(Continued)

OTHER PUBLICATIONS

Bai et al., "Subsea Trees", Subsea Engineering Handbook, https://doi.org/10.1016/B978-0-12-812622-6.00024-5, ISBN 978012812622, Abstract, 2019, 5 pages.

(Continued)

*Primary Examiner* — Aaron L Lembo
(74) *Attorney, Agent, or Firm* — Hogan Lovells US LLP

(57) ABSTRACT

A well intervention tool includes a Christmas tree (XT) adapter connected to an XT, a tubing hanger interface tool aligned axially within the adapter mandrel, and a stab connected to the tubing hanger interface tool, the stab contacting at least one internal component of the XT. The XT includes an XT mandrel. The XT adapter includes an adapter mandrel positioned above the XT mandrel. A system with a well intervention tool includes a blowout preventer (BOP). A system also includes a BOP-integrated adapter that includes a BOP and an XT adapter.

14 Claims, 8 Drawing Sheets

(56) References Cited

U.S. PATENT DOCUMENTS

| | | | | |
|---|---|---|---|---|
| 7,490,673 | B2 * | 2/2009 | Bartlett | E21B 33/038 166/368 |
| 8,230,928 | B2 * | 7/2012 | Cuiper | E21B 33/035 166/368 |
| 8,240,389 | B2 | 8/2012 | Christie | |
| 9,896,897 | B2 | 2/2018 | Brown et al. | |
| 2005/0241821 | A1 * | 11/2005 | Milberger | E21B 33/0353 166/100 |
| 2006/0124314 | A1 | 6/2006 | Haheim et al. | |
| 2009/0071656 | A1 * | 3/2009 | Shaw | E21B 33/0353 166/368 |
| 2012/0012335 | A1 | 1/2012 | White et al. | |
| 2012/0193104 | A1 | 8/2012 | Hoffman et al. | |
| 2014/0151069 | A1 * | 6/2014 | Kajaria | E21B 33/0415 166/382 |

FOREIGN PATENT DOCUMENTS

| | | | | |
|---|---|---|---|---|
| GB | 2397312 | A * | 7/2004 | E21B 33/035 |
| WO | WO-2010065993 | A1 * | 6/2010 | E21B 23/02 |
| WO | 2016131695 | A1 | 8/2016 | |

OTHER PUBLICATIONS

International Search Report and Written Opinion mailed Jul. 23, 2024 in corresponding PCT Application No. PCT/US2024/022459.

* cited by examiner

TREE ADAPTER AND TUBING HANGER INTERFACE TOOL SYSTEM AND METHOD

CROSS-REFERENCE TO RELATED APPLICATION(S)

This Non-Provisional Patent Application is related to and claims the benefit of priority from U.S. Provisional Application No. 63/456,570, titled "TREE ADAPTER AND TUBING HANGER INTERFACE TOOL SYSTEM AND METHOD," filed on Apr. 3, 2023, and incorporated by reference herein in its entirety for all intents and purposes.

BACKGROUND

1. Field of Disclosure

Embodiments of the present disclosure relate to oil and gas tools, and in particular, to systems and methods for a tree adapter and tubing hanger interface tool.

2. Description of the Prior Art

In the production of oil and gas from subsea or surface wells, an assembly of valves, casing spools, and fittings, often referred to as a Christmas tree (XT), may be used to regulate the flow of materials into and out of the well. Various kinds of XTs can contain differently sized or spaced components, such as tubing hangers or internal tree caps, that can be arranged in different ways within the XT. A tubing hanger running or retrieval tool may be designed to be used in a particular XT, based on the particular components of that XT. However, it may be desirable to use alternative tools rather than those specifically designed for particular components of the XT, for example during operations such as well intervention and plug and abandonment campaigns.

SUMMARY

Applicant recognized the problems noted above herein and conceived and developed embodiments of systems and methods, according to the present disclosure, for Christmas tree systems.

In an embodiment, well intervention tool includes a Christmas tree (XT) adapter connected to an XT, a tubing hanger interface tool aligned axially within the adapter mandrel, and a stab connected to the tubing hanger interface tool, the stab contacting at least one internal component of the XT. The XT includes an XT mandrel. The XT adapter includes an adapter mandrel positioned above the XT mandrel.

In another embodiment, a system includes a blowout preventer (BOP), an XT, and an intervention system. The intervention system includes an adapter mandrel axially aligned with a bore of the XT, an adapter connection positioned to couple the adapter mandrel to the XT, a tubing hanger interface tool positioned to extend through the adapter mandrel, and a stab coupled to the tubing hanger interface tool, the stab engaging one or more components of the XT.

In an embodiment, a system includes an XT and an intervention system. The intervention system includes a BOP-integrated adapter, tubing hanger interface tool positioned to extend through the BOP-integrated adapter, and a stab coupled to the tubing hanger interface tool, wherein the stab engages one or more components of the XT. The BOP-integrated adapter includes an XT adapter and a BOP.

BRIEF DESCRIPTION OF THE DRAWINGS

The present technology will be better understood on reading the following detailed description of non-limiting embodiments thereof, and on examining the accompanying drawings, in which.

DETAILED DESCRIPTION

Figure 1A:
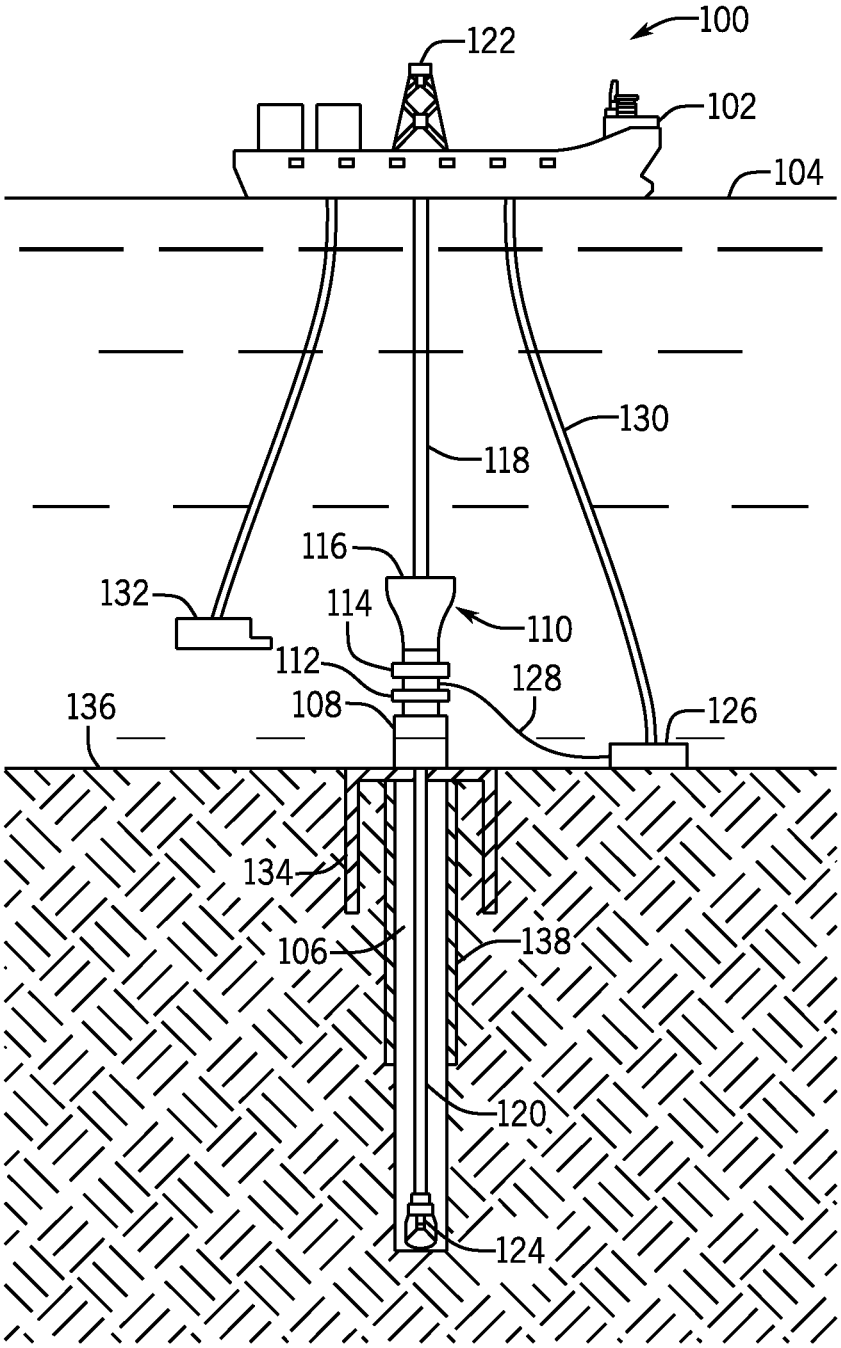
FIG. 1A is a schematic side view of an embodiment of an subsea drilling operation, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present disclosure are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations. Moreover, references to "substantially" or "approximately" or "about" may refer to differences within ranges of +/−10 percent.

Embodiments of the present disclosure are directed toward an XT adapter and tubing hanger interface tool offering a solution for wellbore operations, such as, but not limited to, well intervention and plug and abandonment campaigns. that allows for a simple interface with a tubing hanger or internal tree cap, including in connection with third parties' equipment. Systems and methods may provide an adaptable interface that can be used with a variety of different downhole components, including those provided by different manufacturers. For example, various embodiments may enable third-party equipment to interface with various components of wellbores, such as hangers or internal tree caps. One of the key considerations from operators when selecting contractors for well intervention and plug and abandonment campaigns is the original provider of the XT system. Most tubing hangers or internal tree caps are unique to each provider and, as a result, generally the original provider also supplies running and retrieval tools that can effectively connect and seal to the original XT system equipment. This connection and sealing capability is essential for well intervention and plug and abandonment operations. Current tubing hanger running or retrieval tool designs lock the tool onto the tubing hanger or internal tree cap, either on an internal or an external profile. Most tubing hanger or internal tree cap designs (including the top interface used for installation, retrieval, or intervention) are unique for a particular provider and their associated tubing hanger running and retrieval tool. It is not practical nor economical to design and manufacture tubing hanger running or retrieval tools to suit different third party equipment. Embodiments of the present disclosure provide systems and methods to use the same set of tools (e.g., a tree adapter and a tubing hanger interface tool) for different tubing hangers or internal tree caps along with a project specific stab. In at least one embodiment, systems and methods may design and manufacture the stab on a per-project basis, however, the tree adapter and tubing hanger interface tool may be used across a variety of different XT components, thereby reducing and/or removing restrictions and costs when performing operations on third-party supplied equipment.

In at least one embodiment of the present disclosure, a tree adapter and a tubing hanger interface tool are used to lock onto the wellbore component (e.g., wellhead or tree mandrel). The tree adapter may first lock onto the wellhead or tree mandrel via common connections such as CIW, SG-1 etc. Additionally, the tubing hanger interface tool may lock onto the tree adapter and seal against the internal bore of the tubing hanger or internal tree cap. Accordingly, systems and methods may enable interfacing with and sealing against third-party tubing hangers or internal tree caps (e.g., tubing hangers and/or internal tree caps not provided by the entity providing the tree adapter and tubing hanger interface tool) to allow well intervention and plug and abandonment operations (among other options). Further, the tubing hanger interface tool is able to lock onto the tree adapter and seal against the internal bore of the tubing hanger or internal tree cap with only a project-specific stab to suit the particular equipment. Accordingly, the systems and methods disclosed herein can be used on substantially any type of already-installed wellhead equipment (e.g., subsea equipment, surface equipment, etc.) for wellbore operations Since most of the tools (except for the project-specific stab) are universal and can be used for different wells, costs can be spread against multiple projects and/or years, hence making systems and methods a cheaper, more competitive, and viable option for operators.

Embodiments of the present disclosure may overcome one or more problems with existing units and operations. Various embodiments are directed toward systems and methods to address problems associated with the difficulties of interfacing and sealing against producer-specific wellbore components. In many well operations, most of the tubing hangers or internal tree caps of the installed XT are unique to each provider. As a result, most owners will return to the original installation manufacturer for later work on wellbores because it is usually the case that only a particular provider's tubing hanger running and retrieval tool enables connection and sealing capabilities to that particular provider's tubing hangers and internal tree caps. It is not economical to design and manufacture tubing hanger running and retrieval tools to suit numerous types of third-party equipment, such as for well intervention, plugging, and abandonment operations. For example, individual interfacing components may be expensive to design and manufacture and the return on investment may be low if only a small number of wellbores use such interfaces. Moreover, details regarding interfacing and sealing surfaces for the XT may be limited and extensive testing may be required.

FIG. 1A is a side schematic view of an embodiment of a subsea drilling system 100. It should be appreciated that one or more features have been removed for clarity with the present discussion and that removal or inclusion of certain features is not intended to be limiting, but provided by way of example only. Furthermore, while the illustrated embodiment describes a subsea drilling operation, it should be appreciated that one or more similar processes may be utilized for surface applications and, in various embodiments, similar arrangements or substantially similar arrangements described herein may also be used in surface applications. In this example, the drilling operation includes a vessel 102 floating on a sea surface 104 substantially above a subsea wellbore 106. As noted, the vessel 102 is for illustrative purposes only and systems and methods may further be illustrated with other structures, such as floating/fixed platforms, and the like. A wellbore housing 108 sits at the top of the subsea wellbore 106 and is connected to a blowout preventer (BOP) assembly 110, which may include shear rams 112, sealing rams 114, and/or an annular ram 116. One purpose of the BOP assembly 110 is to help control pressure in the subsea wellbore 106. The BOP assembly 110 is connected to the vessel 102 by a riser 118. During drilling operations, a drill string 120 passes from a rig 122 on the vessel 102, through the riser 118, through the BOP assembly 110, through the wellhead housing 108, and into the subsea wellbore 106. It should be appreciated that reference to the vessel 102 is for illustrative purposes only and that the vessel may be replaced with a floating/fixed platform or other structure. The lower end of the drill string 120 is attached to a drill bit 124 that extends the subsea wellbore 106 as the drill string 120 turns. Additional features shown in FIG. 1 include a mud pump 126 with mud lines 128 connecting the mud pump 126 to the BOP assembly 110, and a mud return line 130 connecting the mud pump 126 to the vessel 102. A remotely operated vehicle (ROV) 132 can be used to make adjustments to, repair, or replace equipment as necessary. Although a BOP assembly 110 is shown in the figures, the wellhead housing 108 could be attached to other well equipment as well, including, for example, a tree, a spool, a manifold, or another valve or completion assembly.

One efficient way to start drilling a subsea wellbore 106 is through use of a suction pile 134. Such a procedure is accomplished by attaching the wellhead housing 108 to the top of the suction pile 134 and lowering the suction pile 134 to a sea floor 136. As interior chambers in the suction pile 134 are evacuated, the suction pile 134 is driven into the sea floor 136, as shown in FIG. 1, until the suction pile 134 is substantially submerged in the sea floor 136 and the wellhead housing 108 is positioned at the sea floor 136 so that further drilling can commence. As the subsea wellbore 106 is drilled, the walls of the wellbore are reinforced with concrete casings 138 that provide stability to the subsea wellbore 106 and help to control pressure from the formation. It should be appreciated that this describes one example of a portion of a subsea drilling operation and may be omitted in various embodiments. In at least one embodiment, systems and methods of the present disclosure may be used for drilling operations that are completed through a BOP and wellhead, where a casing hanger and string are landed in succession. As noted above, configurations with respect to a sea floor or any offshore application are for illustrative purposes and embodiments of the present disclosure may also be utilized in surface drilling applications.

Figure 1B:
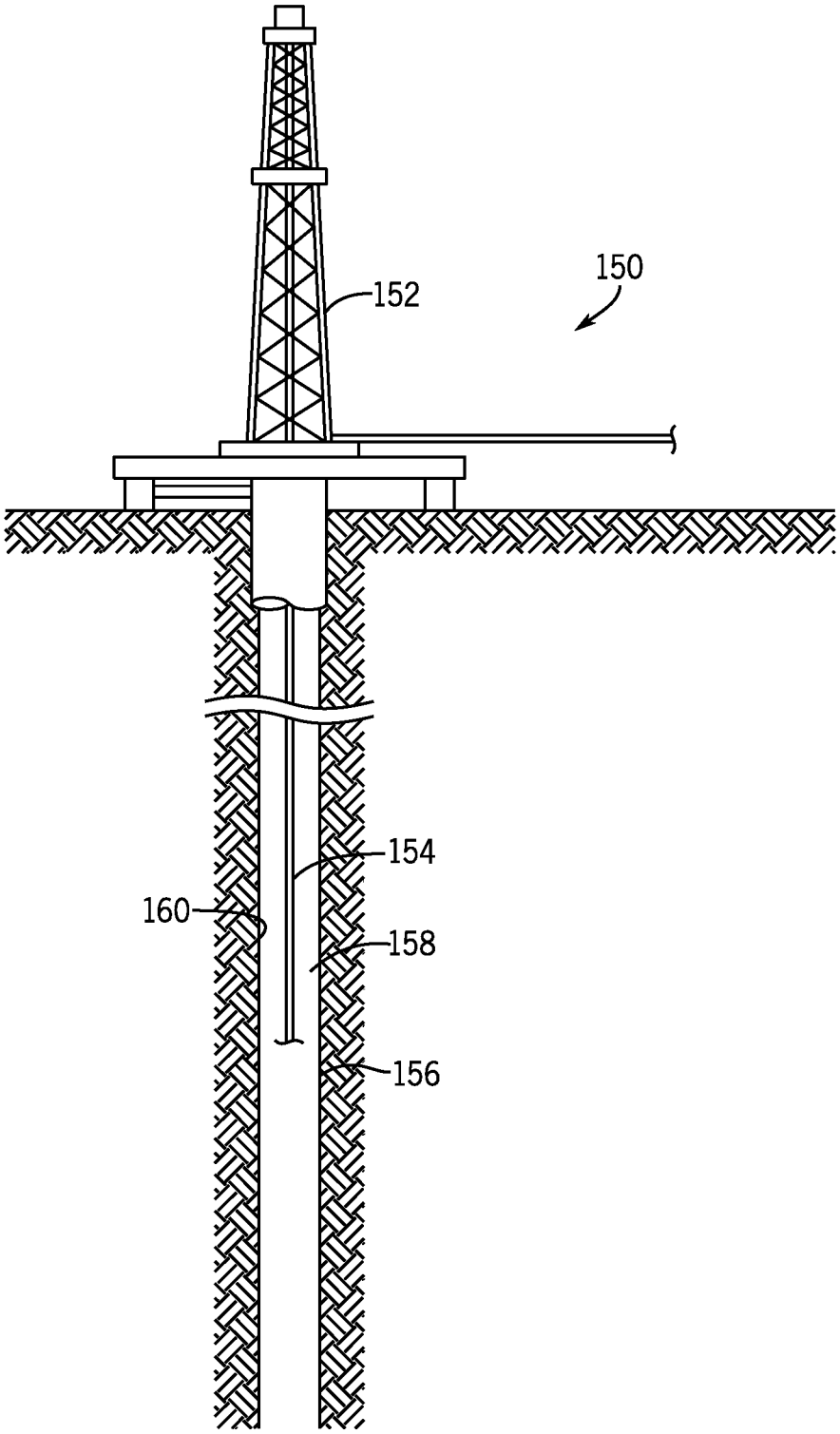
FIG. 1B is a schematic cross-sectional view of an embodiment of a wellbore system, in accordance with embodiments of the present disclosure.

FIG. 1B is a schematic side view of an embodiment of a surface drilling system 150, which may include a completion system, a recovery system, or a drilling system. In this example, the surface drilling system 150 includes a rig 152 and a string 154 coupled to the rig 152. The string 154 may extend through a wellhead assembly (not pictured) such as a blowout preventer (BOP) and/or one or more valve configurations. The wellhead assembly may be a surface assembly, which is not visible in the illustrated embodiment due to a platform of the rig 152, but it should be appreciated that it may be provided in various embodiments. Systems and methods may be utilized in embodiments where one or more completion or recovery operations are initiated, such as when the string 154 is suspended into a surface well wellbore 156. In this example, the string 154 may be a completion or production string, which may include one or more tubulars coupled together and suspended from one or more features, such as the wellhead assembly and/or a casing/tubing hanger, among other options. It should be appreciated that the string 154 may also be a casing string, where one or more cementing operations may be used to cement and secure the string 154 to a wellbore wall. Furthermore, various embodiments may also implement such configurations during drilling operations, where the string 154 includes a drill bit at an end.

In this example, the string 154 is suspended into an annulus 158 formed between the string 154 and a wellbore wall 160. The string 154, as noted above, may be secured to one or more assemblies that are configured to receive and support the string 154, such as a hanger assembly. In operation, the hanger assembly may be arranged within the surface well wellbore 156, or at a surface location, and may include one or more seals to control pressure within the wellbore.

Figure 2A:
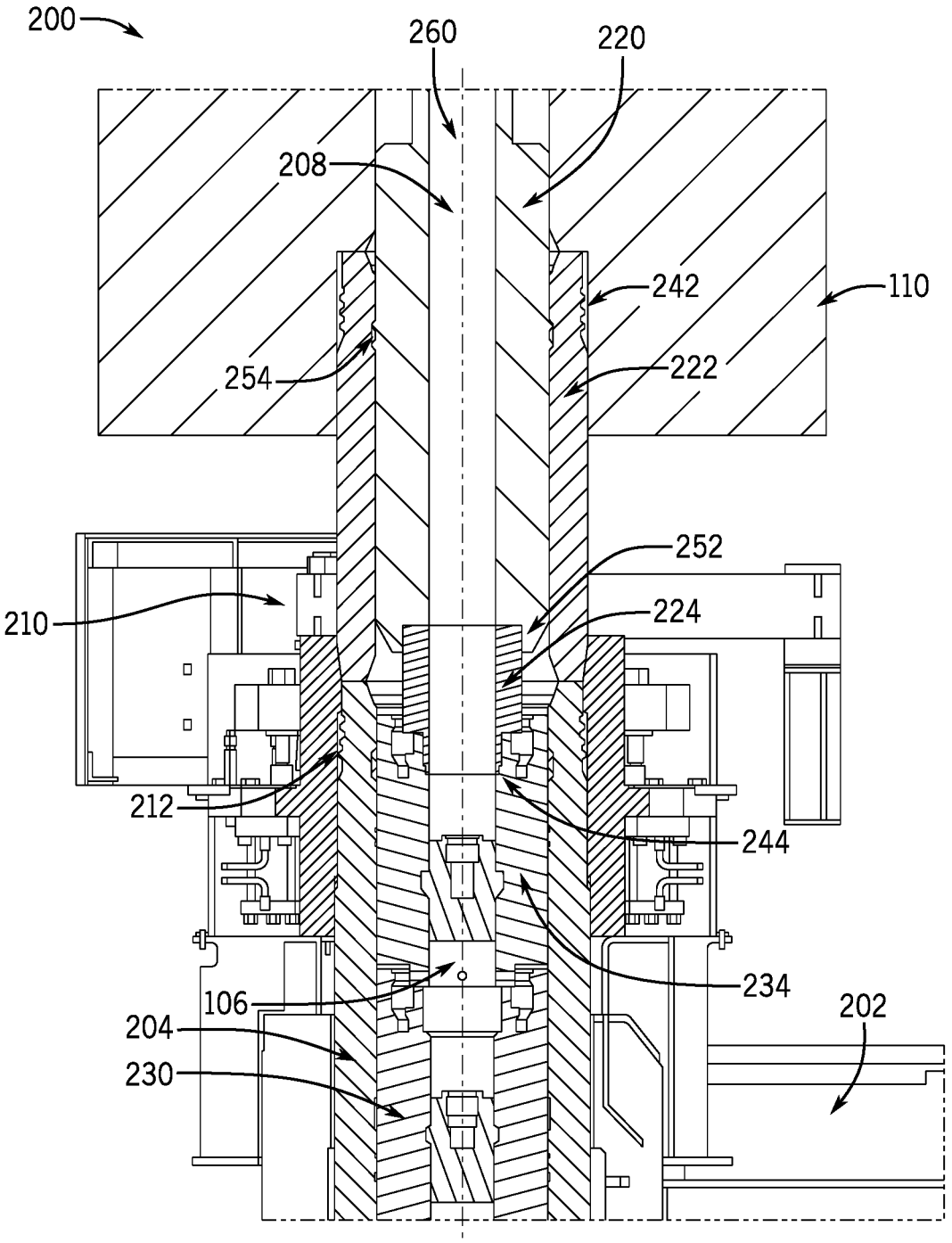
FIG. 2A is a schematic cross-sectional view of an embodiment an XT adapter and tubing hanger interface tool incorporated in a type of horizontal XT with an internal tree cap, in accordance with embodiments of the present disclosure.

FIG. 2A is a schematic cross-sectional view of an embodiment of a subsea XT stack-up 200. The subsea XT stack-up 200 is comprised of a BOP assembly 110 and an XT 202 comprising a tubing hanger 230 and an internal tree cap 234 both aligned axially along an axis 260 within a mandrel 204 of the XT 202. The XT 202 is positioned surrounding the mandrel 204 of the subsea wellbore 106. It should be appreciated that this example embodiment is a subsea operation, but various embodiments may also be applied to surface operations.

As shown, an XT adapter 210 locks into the XT 202 using a connection 212 between the XT adapter 210 and the mandrel 204. The XT adapter 210 may include an associated adapter mandrel 222 that is positioned above the mandrel 204 and aligns axially with the mandrel 204 along the axis 260. It should be appreciated that while the BOP assembly 110 is typically situated directly above the mandrel 204 of the XT 202, the inclusion of the XT adapter 210 with its associated adapter mandrel 222 above the XT 202 makes it so the BOP assembly 110 is positioned directly above the adapter mandrel 222 instead, and thus positioned farther from the mandrel 204. The addition of the XT adapter 210 and associated adapter mandrel 222 essentially elongates the subsea wellbore 106 to create an extended wellbore 208 that extends further above the XT 202, and is surrounded axially by the adapter mandrel 222.

In this example, the tubing hanger interface tool 220 is shown inside of the adapter mandrel 222 and axially aligned along the extended wellbore 208. In at least one embodiment, the tubing hanger interface tool 220 locks to the adapter mandrel 222 via an internal locking profile 254. The tubing hanger interface tool 220 may be secured to a stab 224 via a threaded connection 252. The stab 224 extends downwards axially along the axis 260, from the tubing hanger interface tool 220, to stab into the internal tree cap 234 and form a seal 244 with the internal tree cap 234. In at least one embodiment, the seal 244 may be a metal-to-metal seal. In at least one embodiment, the seal 244 may be an elastomer or polymer seal. In at least one embodiment, combinations of seals may be used, which may be particularly selected based on operating conditions. This intervention in the XT 202 allows various operations related to oil and gas to take place in the XT 202 and further downhole in the subsea wellbore 106.

Embodiments of the present disclosure may include an adapter and mandrel connection 212, which may be any common connection such as CIW, SG-1 etc. The adapter mandrel and BOP locking mechanism 242 may be any common connection such as CIW, SG-1 etc. The internal locking profile 254 between the adapter mandrel 222 and the tubing hanger interface tool 220 may be carried out by the use of dogs to prevent or impart movement through physical engagement or an actuation sleeve. The manner in which the stab 224 and the internal tree cap 234 form the seal 244 may be via an elastomeric sealing mechanism, among other feasible mechanisms.

Figure 2B:
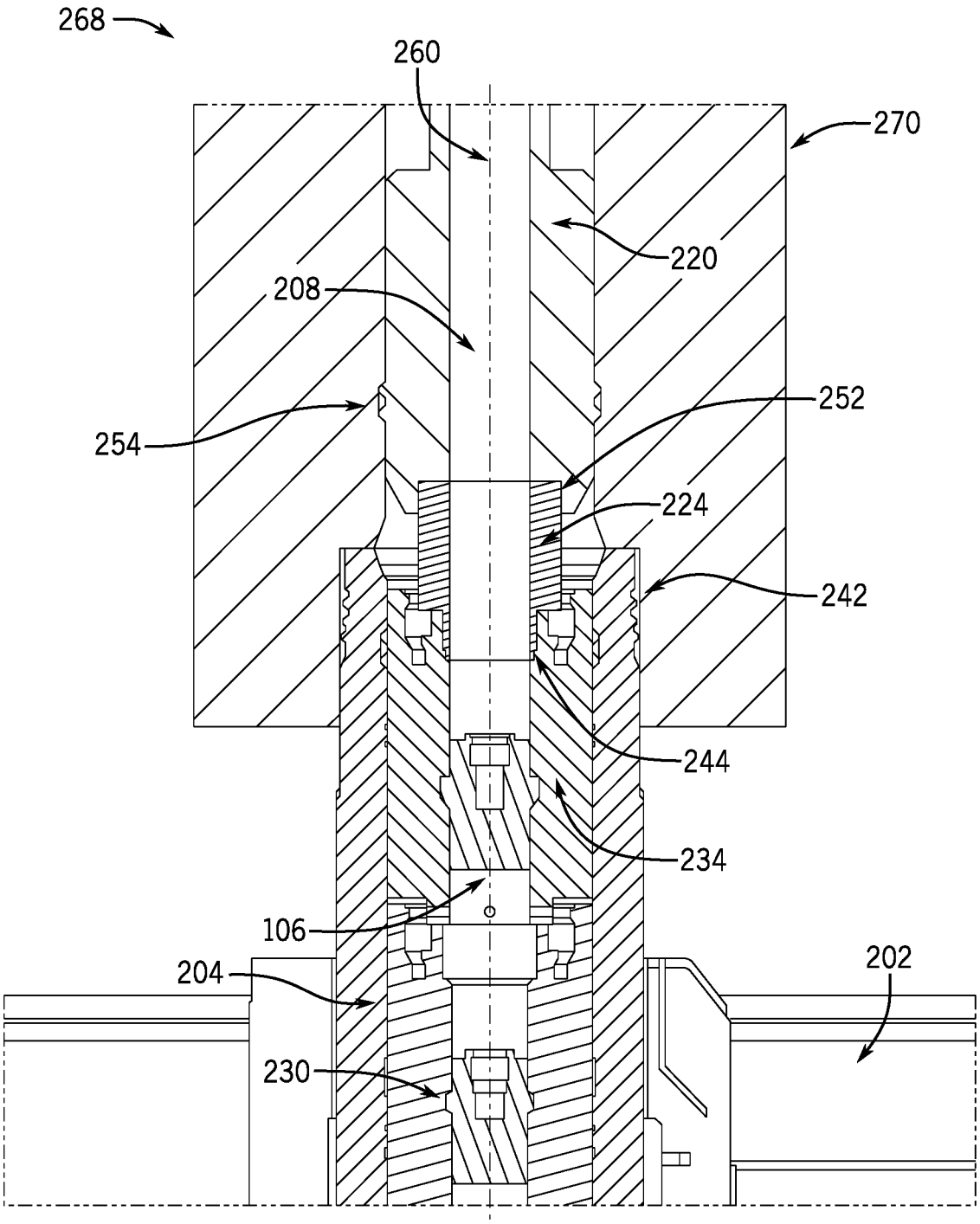
FIG. 2B is a schematic cross-sectional view of an embodiment of an XT adapter integrated into a BOP and a hanger interface tool incorporated in a type of horizontal XT with an internal tree cap, in accordance with embodiments of the present disclosure.

FIG. 2B is a schematic cross-sectional view of an embodiment of a subsea XT stack-up 268, which shares similar features with FIG. 2A, such as the XT 202, the tubing hanger interface tool 220, and others, which will be identified with like reference numerals for convenience purposes only and not to limit the scope of the present disclosure. A main difference between the subsea XT stack-up 200 of FIG. 2A and the subsea XT stack-up 268 of FIG. 2B is that the subsea XT stack-up 268 contains a BOP-integrated adapter 270. The BOP-integrated adapter 270 combines the XT adapter 210, adapter mandrel 222, and BOP 110 of FIG. 2A into a single unit of the BOP-integrated adapter 270. The BOP-integrated adapter 270 may attach directly to the mandrel 204 of the XT 202 via the BOP locking mechanism 242 without the use of an adapter mandrel 222. The internal locking profile 254 may function to lock the BOP-integrated adapter 270 to the tubing hanger interface tool 220. The locking mechanism 242 may function to lock the BOP-integrated adapter 270 to the mandrel 204.

In the embodiment illustrated in FIG. 2B, as with FIG. 2A, the tubing hanger interface tool 220 may be secured to a stab 224 via a threaded connection 252. The stab 224 extends downwards axially along the axis 260, from the tubing hanger interface tool 220 in the BOP-integrated adapter 270, to stab into the internal tree cap 234 and form a seal 244 with the internal tree cap 234. In at least one embodiment, the seal 244 may be a metal-to-metal seal. In at least one embodiment, the seal 244 may be an elastomer or polymer seal. In at least one embodiment, combinations of seals may be used, which may be particularly selected based on operating conditions.

Figure 3A:
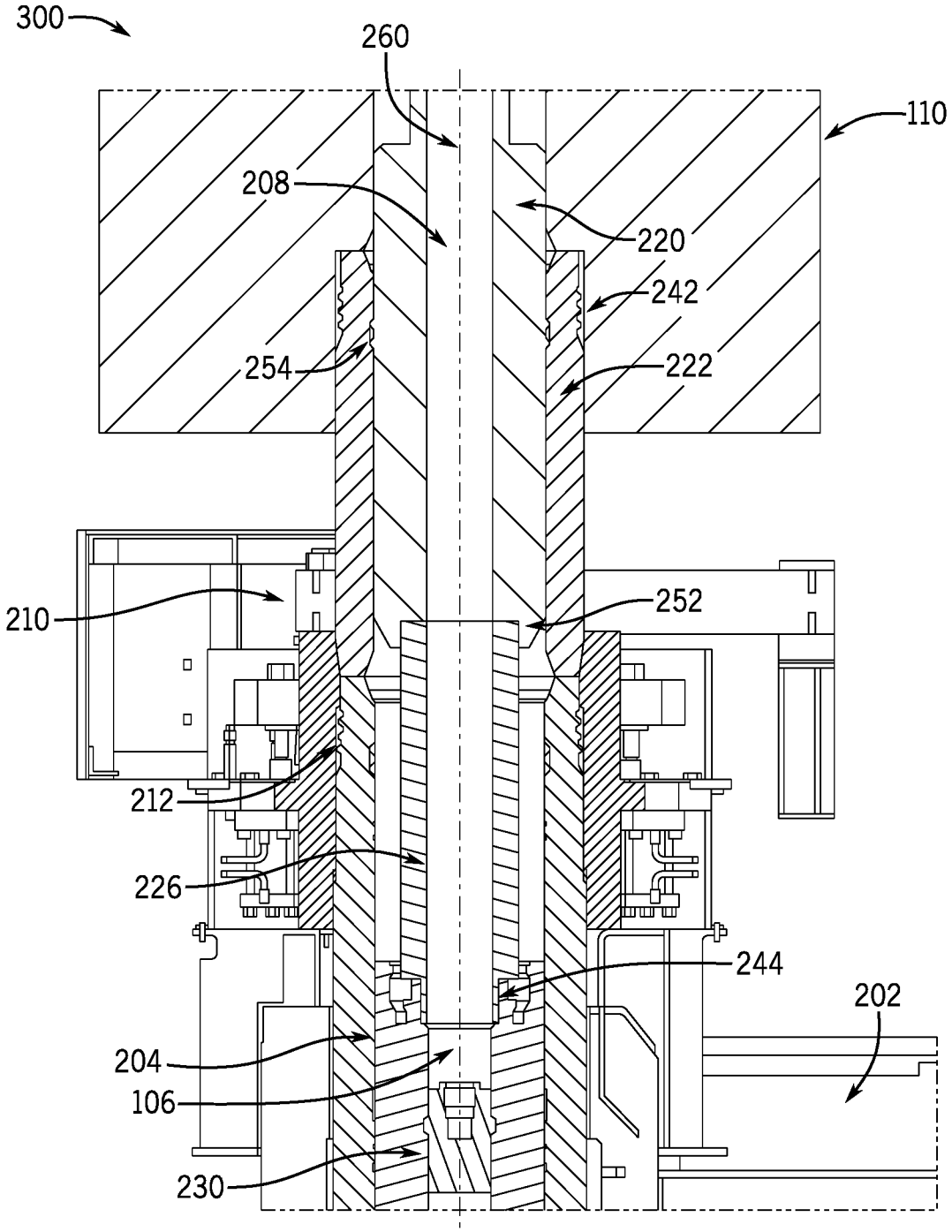
FIG. 3A is a schematic cross-sectional view of an embodiment an XT adapter and tubing hanger interface tool incorporated in a type of horizontal XT with a tubing hanger, in accordance with embodiments of the present disclosure.

FIG. 3A is a schematic cross-sectional view of another embodiment of a subsea XT stack-up 300. The subsea XT stack-up 300 is comprised of the BOP assembly 110 and the XT 202 comprising the tubing hanger 230 aligned axially along the axis 260 within the mandrel 204 of the XT 202. Unlike FIG. 2A, this embodiment does not contain the internal tree cap 234. The XT 202 is positioned surrounding the mandrel 204 of the subsea wellbore 106. As noted herein, various embodiments may show subsea systems, but systems and methods may also be applicable to surface applications.

As shown, the XT adapter 210 locks into the XT 202 using the connection 212 between the XT adapter 210 and the mandrel 204. The XT adapter 210 may include the associated adapter mandrel 222 that is positioned above the mandrel 204 and aligns axially with the mandrel 204 along the axis 260. It should be appreciated that while the BOP assembly 110 is typically situated directly above the mandrel 204 of the XT 202, the inclusion of the XT adapter 210 with its associated adapter mandrel 222 above the XT 202 makes it so the BOP assembly 110 is positioned directly above the adapter mandrel 222 instead, and thus positioned farther from the mandrel 204. The addition of the XT adapter 210 and associated adapter mandrel 222 essentially elongates the subsea wellbore 106 to create the extended wellbore 208 that extends further above the XT 202, and is surrounded axially by the adapter mandrel 222.

In this example, the tubing hanger interface tool 220 is shown inside of the adapter mandrel 222 and axially aligned along the extended wellbore 208. In at least one embodiment, the tubing hanger interface tool 220 locks to the adapter mandrel 222 via the internal locking profile 254. The tubing hanger interface tool 220 may be secured to a longer stab 226 via the threaded connection 252. The longer stab 226 extends downwards axially along the axis 260, from the tubing hanger interface tool 220, to stab into the tubing hanger 230 and form the seal 244 with the tubing hanger 234. It should be appreciated that in this example embodiment, the longer stab 226 is designed to be longer than the stab 224 of the example embodiment of FIG. 2A. The longer stab 226 of this example embodiment is designed to be longer to reach far enough into the subsea wellbore 106 to make contact and form the seal 244 with the tubing hanger 230, since there is no internal tree cap 234 in this example embodiment. In at least one embodiment, the seal 244 may be a metal-to-metal seal. In at least one embodiment, the seal 244 may be an elastomer or polymer seal. In at least one embodiment, combinations of seals may be used, which may be particularly selected based on operating conditions. This intervention in the XT 202 by the XT adapter 210 and tubing hanger interface tool 220 allows various operations related to oil and gas to take place in the XT 202 and further downhole in the subsea wellbore 106.

Embodiments of the present disclosure may include the adapter and mandrel connection 212, which may be any common connection such as CIW, SG-1 etc. The adapter mandrel and BOP locking mechanism 242 may be any common connection such as CIW, SG-1 etc. The internal locking profile 254 between the adapter mandrel 222 and the tubing hanger interface tool 220 may be carried out by the use of dogs to prevent or impart movement through physical engagement or an actuation sleeve. The manner in which the longer stab 226 and the tubing hanger 230 form the seal 244 may be via an elastomeric sealing mechanism, among other feasible mechanisms.

Figure 3B:
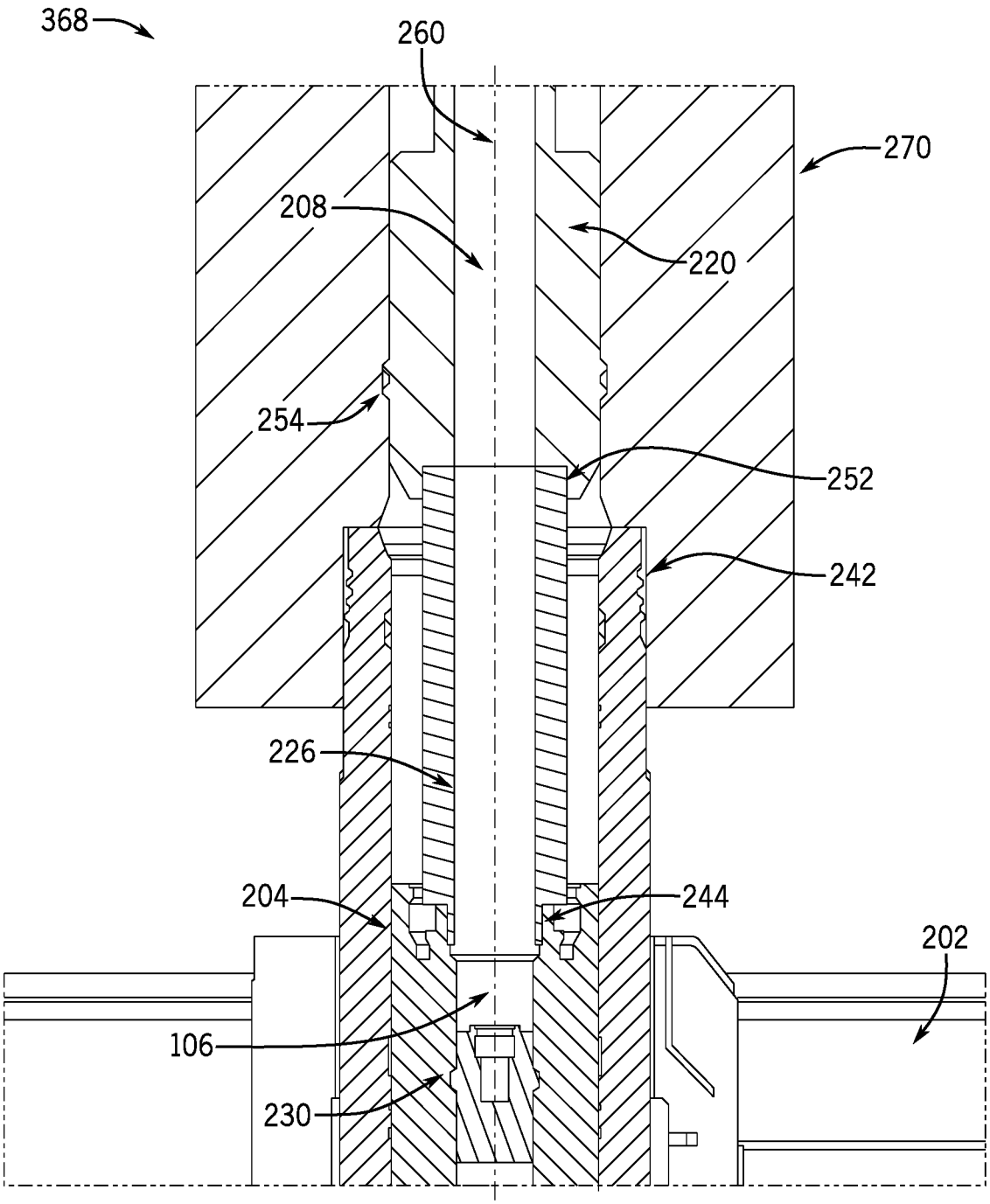
FIG. 3B is a schematic cross-sectional view of an embodiment of an XT adapter integrated into a BOP and a tubing hanger interface tool incorporated in a type of horizontal XT with a tubing hanger, in accordance with embodiments of the present disclosure.

FIG. 3B is a schematic cross-sectional view of an embodiment of a subsea XT stack-up 368, which shares similar features with FIG. 3A, such as the XT 202, the tubing hanger interface tool 220, and others, which will be identified with like reference numerals for convenience purposes only and not to limit the scope of the present disclosure. A main difference between the subsea XT stack-up 300 of FIG. 3A and the subsea XT stack-up 368 of FIG. 3B is that the subsea XT stack-up 368 contains the BOP-integrated adapter 270. The BOP-integrated adapter 270 essentially combines the XT adapter 210, adapter mandrel 222, and BOP 110 of FIG. 3A into a single unit of the BOP-integrated adapter 270. The BOP-integrated adapter 270 may attach directly to the mandrel 204 of the XT 202 via the BOP locking mechanism 242 without the use of an adapter mandrel 222. The internal locking profile 254 may function to lock the BOP-integrated adapter 270 to the tubing hanger interface tool 220. The locking mechanism 242 may function to lock the BOP-integrated adapter 270 to the mandrel 204.

In the embodiment illustrated in FIG. 3B, as with FIG. 3A, the tubing hanger interface tool 220 may be secured to a longer stab 226 via the threaded connection 252. The longer stab 226 extends downwards axially along the axis 260, from the tubing hanger interface tool 220 of the BOP-integrated adapter 270, to stab into the tubing hanger 230 and form the seal 244 with the tubing hanger 234. It should be appreciated that in this example embodiment, the longer stab 226 is designed to be longer than the stab 224 of the example embodiment of FIG. 2A. The longer stab 226 of this example embodiment is designed to be longer to reach far enough into the subsea wellbore 106 to make contact and form the seal 244 with the tubing hanger 230, since there is no internal tree cap 234 in this example embodiment. In at least one embodiment, the seal 244 may be a metal-to-metal seal. In at least one embodiment, the seal 244 may be an elastomer or polymer seal. In at least one embodiment, combinations of seals may be used, which may be particularly selected based on operating conditions.

Figure 4A:
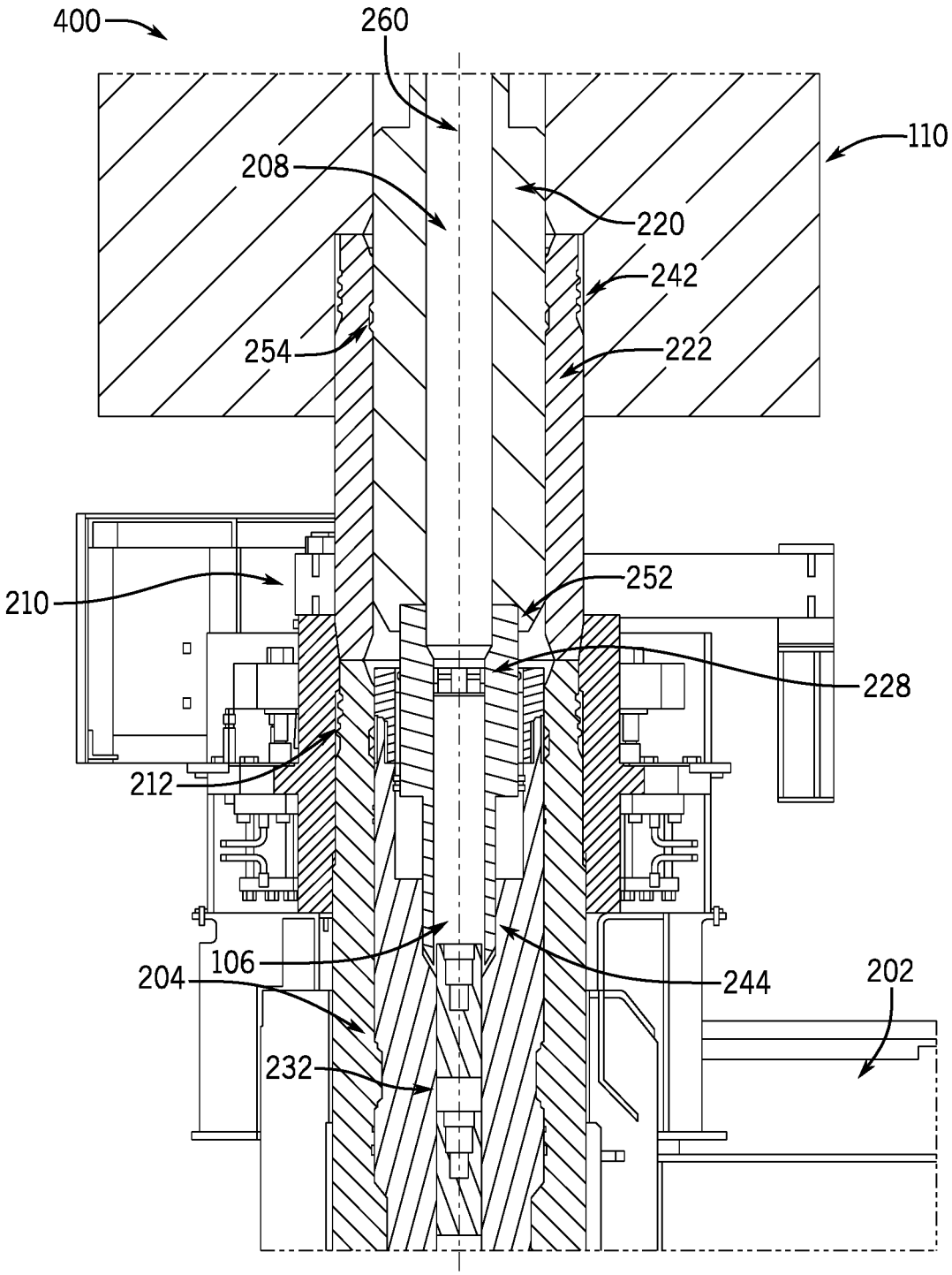
FIG. 4A is a schematic cross-sectional view of an embodiment an XT adapter and tubing hanger interface tool incorporated in another type of horizontal XT with a tubing hanger, in accordance with embodiments of the present disclosure.

FIG. 4A is a schematic cross-sectional view of another embodiment of a subsea XT stack-up 400. The subsea XT stack-up 400 is comprised of the BOP assembly 110 and the XT 202 comprising an alternative tubing hanger 232 aligned axially along the axis 260 within the mandrel 204 of the XT 202. Like FIG. 3A, this embodiment does not contain an internal tree cap 234. The XT 202 is positioned surrounding the mandrel 204 of the subsea wellbore 106. As noted herein, various embodiments may show subsea systems, but systems and methods may also be applicable to surface applications.

As shown, the XT adapter 210 locks into the XT 202 using the connection 212 between the XT adapter 210 and the mandrel 204. The XT adapter 210 may include an associated adapter mandrel 222 that is positioned above the mandrel 204 and aligns axially with the mandrel 204 along the axis 260. It should be appreciated that while the BOP assembly 110 is typically situated directly above the mandrel 204 of the XT 202, the inclusion of the XT adapter 210 with its associated adapter mandrel 222 above the XT 202 makes it so the BOP assembly 110 is positioned directly above the adapter mandrel 222 instead, and thus positioned farther from the mandrel 204. The addition of the XT adapter 210 and associated adapter mandrel 222 essentially elongates the subsea wellbore 106 to create the extended wellbore 208 that extends further above the XT 202, and is surrounded axially by the adapter mandrel 222.

In this example, the tubing hanger interface tool 220 is shown inside of the adapter mandrel 222 and axially aligned along the extended wellbore 208. In at least one embodiment, the tubing hanger interface tool 220 locks to the adapter mandrel 222 via the internal locking profile 254. The tubing hanger interface tool 220 may be secured to an alternative stab 228 via the threaded connection 252. The alternative stab 228 extends downwards axially along the axis 260, from the tubing hanger interface tool 220, to stab into the alternative tubing hanger 230 and make the seal 244 with the alternative tubing hanger 234. It should be appreciated that in this example embodiment, the alternative stab 228 is designed to be a different size and shape than the stab 224 and longer stab 226 of the example embodiments of FIG. 2A and FIG. 3A, respectively. The alternative stab 228 of this example embodiment is designed to be a particular shape in order to reach far enough into the subsea wellbore 106 to make contact and form a seal 244 with the alternative tubing hanger 232, since the alternative tubing hanger takes a different size and shape than the tubing hanger 230 of FIG. 3A. In at least one embodiment, the seal 244 may be a metal-to-metal seal. In at least one embodiment, the seal 244 may be an elastomer or polymer seal. In at least one embodiment, combinations of seals may be used, which may be particularly selected based on operating conditions. This intervention in the XT 202 by the XT adapter 210 and tubing hanger interface tool 220 allows various operations related to oil and gas to take place in the XT 202 and further downhole in the subsea wellbore 106.

Embodiments of the present disclosure may include the adapter and mandrel connection 212, which may be any common connection such as CIW, SG-1 etc. The adapter mandrel and BOP locking mechanism 242 may be any common connection such as CIW, SG-1 etc. The internal locking profile 254 between the adapter mandrel 222 and the tubing hanger interface tool 220 may be carried out by the use of dogs to prevent or impart movement through physical engagement or an actuation sleeve. The manner in which the alternative stab 228 and the alternative tubing hanger 232 form the seal 244 may be via an elastomeric sealing mechanism, among other feasible mechanisms.

Figure 4B:
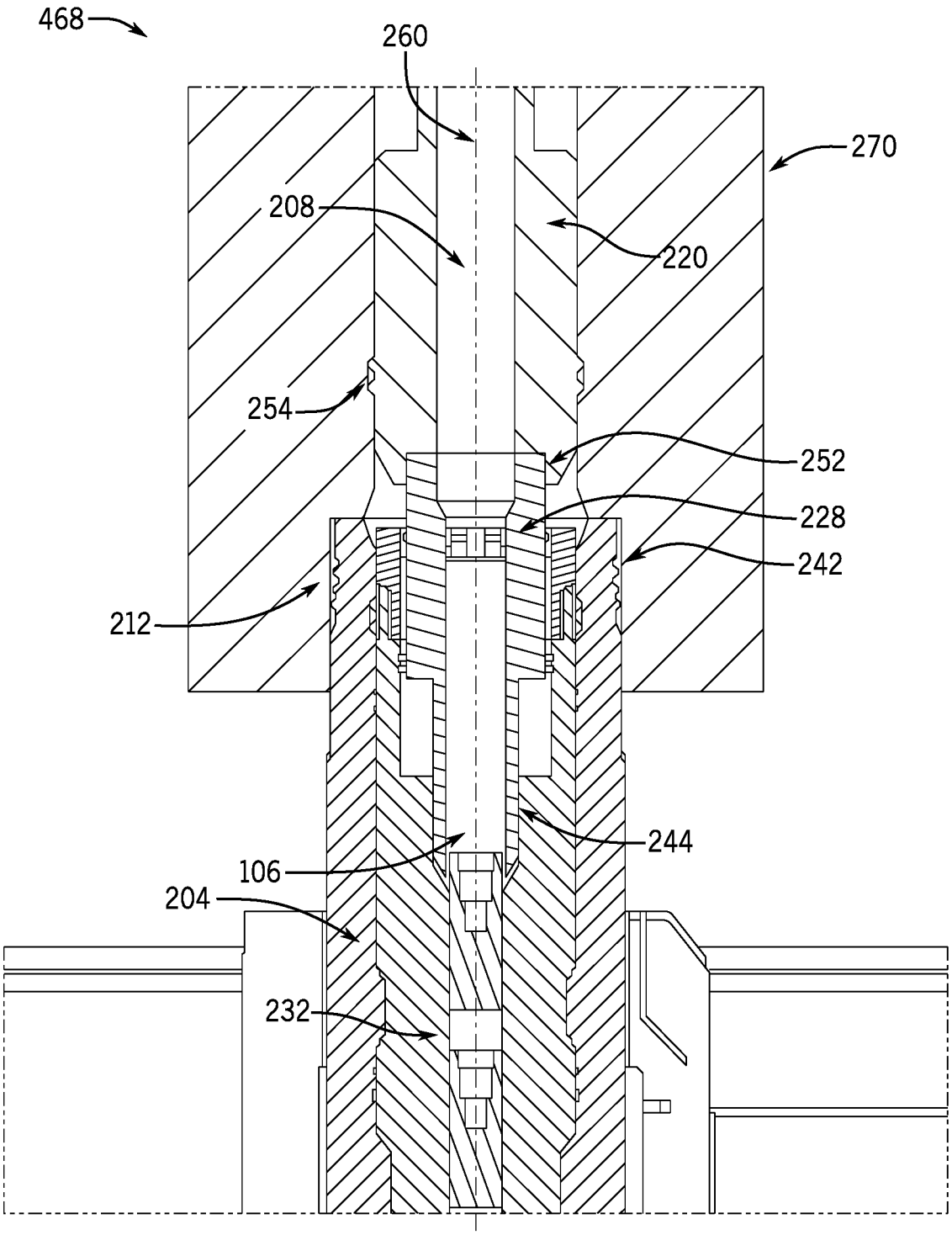
FIG. 4B is a schematic cross-sectional view of an embodiment of an XT adapter integrated into a BOP an a tubing hanger interface tool incorporated in another type of horizontal XT with a tubing hanger, in accordance with embodiments of the present disclosure.

FIG. 4B is a schematic cross-sectional view of an embodiment of a subsea XT stack-up 468, which shares similar features with FIG. 4A, such as the XT 202, the tubing hanger interface tool 220, and others, which will be identified with like reference numerals for convenience purposes only and not to limit the scope of the present disclosure. A main difference between the subsea XT stack-up 400 of FIG. 4A and the subsea XT stack-up 468 of FIG. 4B is that the subsea XT stack-up 468 contains the BOP-integrated adapter 270. The BOP-integrated adapter 270 essentially combines the XT adapter 210, adapter mandrel 222, and BOP 110 of FIG. 4A into a single unit of the BOP-integrated adapter 270. The BOP-integrated adapter 270 may attach directly to the mandrel 204 of the XT 202 via the BOP locking mechanism 242 without the use of an adapter mandrel 222. The internal locking profile 254 may function to lock the BOP-integrated adapter 270 to the tubing hanger interface tool 220. The locking mechanism 242 may function to lock the BOP-integrated adapter 270 to the mandrel 204.

In the embodiment illustrated in FIG. 4B, as with FIG. 4A, the tubing hanger interface tool 220 may be secured to an alternative stab 228 via the threaded connection 252. The alternative stab 228 extends downwards axially along the axis 260, from the tubing hanger interface tool 220, to stab into the alternative tubing hanger 230 and make the seal 244 with the alternative tubing hanger 234. It should be appreciated that in this example embodiment, the alternative stab 228 is designed to be a different size and shape than the stab 224 and longer stab 226 of the example embodiments of FIGS. 2A, 2B, 3A, and 3B. The alternative stab 228 of this example embodiment is designed to be a particular shape in order to reach far enough into the subsea wellbore 106 to make contact and form a seal 244 with the alternative tubing hanger 232, since the alternative tubing hanger takes a different size and shape than the tubing hanger 230 of FIG. 3A. In at least one embodiment, the seal 244 may be a metal-to-metal seal. In at least one embodiment, the seal 244 may be an elastomer or polymer seal. In at least one embodiment, combinations of seals may be used, which may be particularly selected based on operating conditions.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A well intervention tool, comprising:

an XT adapter connected to an XT, the XT including an XT mandrel, wherein the XT adapter comprises an adapter mandrel positioned above the XT mandrel;

a tubing hanger interface tool aligned axially within the adapter mandrel; and a stab connected to the tubing hanger interface tool, wherein the stab contacts an internal tree cap or a tubing hanger.

2. The well intervention tool of claim 1, wherein the stab is connected to the tubing hanger interface tool by a threaded connection.

3. The well intervention tool of claim 1, further comprising:

A metal-to-metal seal between the stab and the internal tree cap or the tubing hanger.

4. The well intervention tool of claim 1, further comprising:

a polymeric or elastomeric seal between the stab and the internal tree cap or the tubing hanger.

5. The well intervention tool of claim 1, wherein the adapter mandrel and the tubing hanger interface tool are connected using dogs or an actuation sleeve.

6. A system, comprising:

a BOP;

an XT; and an intervention system, comprising:

an adapter mandrel, the adapter mandrel axially aligned with a bore of the XT;

an adapter connection positioned to couple the adapter mandrel to the XT;

a tubing hanger interface tool positioned to extend through the adapter mandrel; and a stab connected to the tubing hanger interface tool, wherein the stab contacts an internal tree cap or a tubing hanger.

7. The system of claim 6, wherein the stab is connected to the tubing hanger interface tool by a threaded connection.

8. The system of claim 6, further comprising:

a metal-to-metal seal between the stab and the internal tree cap or the tubing hanger.

9. The system of claim 6, further comprising:

a polymeric or elastomeric seal between the stab and the internal tree cap or the tubing hanger.

10. The system of claim 6, wherein the adapter mandrel and the tubing hanger interface tool are connected using dogs or an actuation sleeve.

11. A system, comprising:

an XT; and an intervention system, comprising:

a BOP-integrated adapter, comprising an XT adapter and a BOP;

a tubing hanger interface tool positioned to extend through the BOP-integrated adapter; and a stab connected to the tubing hanger interface tool, wherein the stab contacts an internal tree cap or a tubing hanger.

12. The system of claim 11, wherein the stab is connected to the tubing hanger interface tool by a threaded connection.

13. The system of claim 11, further comprising:

a seal between the stab and the one or more components of the XT, the seal comprising one of a metal-to-metal seal, a polymeric seal, or an elastomeric seal.

14. The system of claim 11, wherein the XT adapter of the BOP-integrated adapter and the tubing hanger interface tool are connected using dogs or an actuation sleeve.

* * * * *